US006999867B2

(12) United States Patent
Konno

(10) Patent No.: US 6,999,867 B2
(45) Date of Patent: Feb. 14, 2006

(54) ENGINE CONTROL UNIT

(75) Inventor: Takeshi Konno, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/791,355

(22) Filed: Mar. 1, 2004

(65) Prior Publication Data

US 2004/0204815 A1 Oct. 14, 2004

(30) Foreign Application Priority Data

Mar. 28, 2003 (JP) ..... 2003-092302

(51) Int. Cl.
*G06G 7/70* (2006.01)

(52) U.S. Cl. ..... 701/112; 701/102; 701/114; 701/115; 340/426; 307/10.2; 307/10.3; 307/10.4; 307/10.5

(58) Field of Classification Search ..... 701/102, 701/112, 114, 115; 307/10.2, 10.3, 10.4, 307/10.5; 340/426
See application file for complete search history.

(56) References Cited

U.S. PATENT DOCUMENTS 4,749,873 A 6/1988 Mutoh et al. ..... 307/10 AT
4,864,998 A * 9/1989 Onishi ..... 123/674
5,708,307 A * 1/1998 Iijima et al. ..... 307/10.5

FOREIGN PATENT DOCUMENTS

JP 8-169303 7/1996

* cited by examiner

*Primary Examiner*—Tony M. Argenbright
*Assistant Examiner*—Johnny H. Hoang
(74) *Attorney, Agent, or Firm*—Hamre, Schumann, Mueller & Larson, P.C.

(57) ABSTRACT

An engine control unit which can solve current leakage from an ignition system or the like due to attachment of water drops or the like when washing a vehicle. A power circuit receiving power supply from a battery, supplying the power to an engine control unit, and maintaining supply of a power to the engine control unit even when the power supply from the battery is stopped, a unit disconnection detecting circuit for detecting that the engine control unit is disconnected from the battery, and an EEPROM are provided, and when disconnection of the engine control unit is detected, an engine stop flag is stored in the EEPROM, and when the engine control unit is connected and a power is supplied from the battery, the engine is not permitted to start for a certain period of time if the engine stop flag is stored in the EEPROM.

5 Claims, 8 Drawing Sheets

OPERATION TIMING CHART (WHEN BATTERY IS DEAD)

ENGINE CONTROL UNIT

FIELD OF THE INVENTION

The present invention relates to an engine control unit for controlling a vehicle engine, such as a motorcycle or an automotive vehicle and, more specifically, to an engine control unit in which a problem of current leakage from an ignition system or the like due to attachment of water drops and the like after car wash can be solved.

BACKGROUND OF THE INVENTION

In an engine control unit in the related art, a structure including an immobilizer unit for permitting engine start by collating an ID code (identification code for collation) registered to an ignition key and an ID code which is registered to the vehicle body in advance, and an electronic gasoline injection (EGI) unit for controlling engine start based on signals from the immobilizer unit, and the EGI unit and the engine are connected with a coupling connector is disclosed by JP-A-8-169303.

In a vehicle body having an engine control unit disclosed in JP-A-8-169303 (for example, a two-wheeler), there is a case in which car wash is performed in a state in which a battery and an EGI unit is disconnected. However, when the battery and the EGI unit are connected and the engine was started after car wash, current leakage may occur in an ignition system or the like due to attachment of water drops since there is no specific measure taken in the EGI unit described above. Therefore, when the engine is started, such unfavorable state that the ignition system of the engine is not supplied with sufficient current and thus is not activated may result. Therefore, provision of an engine control unit that can cope with the after-car-wash problem is needed.

In view of such problems described above, it is an object of the invention to provide an engine control unit which can solve the problem of current leakage from the ignition system or the like due to attachment of water drops and the like when vehicles such as a motorcycle or an automotive vehicle is washed.

SUMMARY OF THE INVENTION

In order to solve the problem described above, an engine control unit according to the present invention is an engine control unit for controlling operation of a vehicle engine provided with power supply means for receiving a power from an external power source and supplying a power required for the engine control unit, including unit disconnection detecting means for detecting that the engine control unit is disconnected from the external power source and that the engine control unit is connected to the external power source, and storage means for storing predetermined information, characterized in that the engine control unit stores an engine stop flag in the storage means when disconnection of the engine control unit is detected by the unit disconnection detecting means and does not permit operation of the engine for a predetermined time period in the case where the engine stop flag is stored in the storage means when connection of the engine control unit is detected.

Accordingly, it can be adapted in such a manner that after the vehicle is washed, operation of the engine is permitted only after water drops or the like are dried. Therefore, the effect of leakage at the ignition system or the like due to water drops may be reduced.

The engine control unit of the present invention is characterized in that the engine control unit permits operation of the engine according to the result of collation between the ID code received from the outside and the ID code which is registered in advance.

Accordingly, when a predetermined time period is elapsed after the engine control unit is connected to the external power source (battery), the normal process routine of an immobilizer is restored, and thus it is not necessary to modify the conventional process routine significantly, which realizes reduction of cost in design.

The engine control unit of the present invention is characterized in that the engine control unit also stops operation of control systems which are not used for controlling the engine for a predetermined time period in the case where the engine stop flag is stored in the storage means when a power is supplied from the external power source.

Accordingly, whether or not it is the engine control unit according to the present invention can be identified simply by checking the displayed state of a meter and the like.

The engine control unit of the present invention is characterized in that the unit disconnection detecting means observes an input voltage based on variations in the input voltage at the power supply means and, when the voltage has not reached a predetermined value for more than a certain period of time, determines that the engine control unit is disconnected.

Accordingly, disconnection of the engine control unit and battery shortage can be identified for controlling.

DETAILED DESCRIPTION OF THE INVENTION

Figure 1:
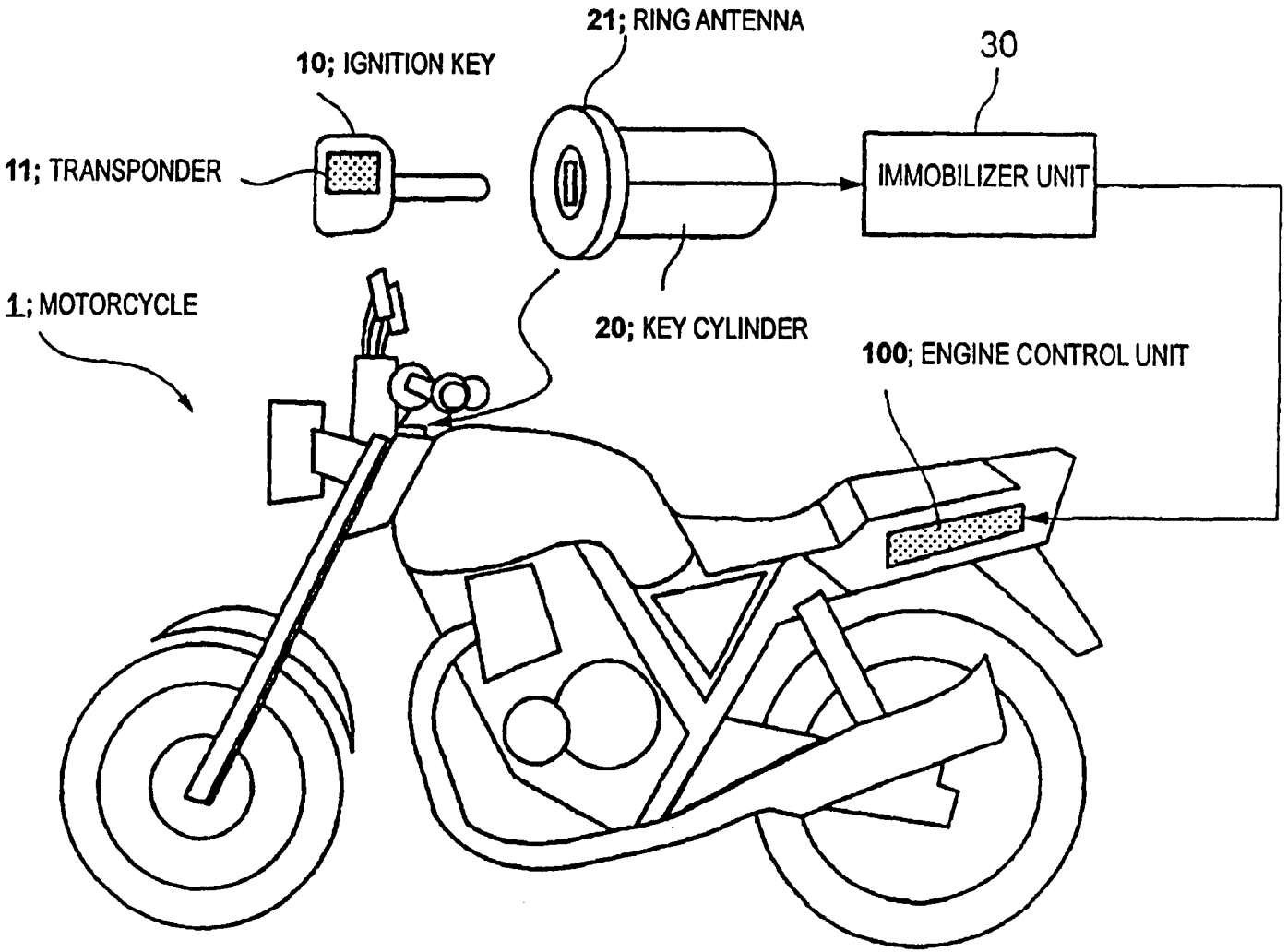
FIG. 1 is a drawing showing an example of an engine control unit of the present invention mounted on a vehicle.

Referring now to the drawings, an embodiment of the present invention will be described.

FIG. 1 is a drawing showing an example of an engine control unit of the present invention mounted on a vehicle, in which the engine control unit of the present invention is mounted on a two-wheeler 1. A system using the engine control unit of the present invention integrally includes a combination of an ignition key 10 having a transponder 11 in which an ID code (identification code for collation) is stored, a key cylinder 20 having a ring antenna 21 for communicating with a power supply to the transponder 11, and an engine control unit (referred also to "ECU unit") 100 having an ID collating function with the transponder 11 via an immobilizer unit 30.

Figure 2:
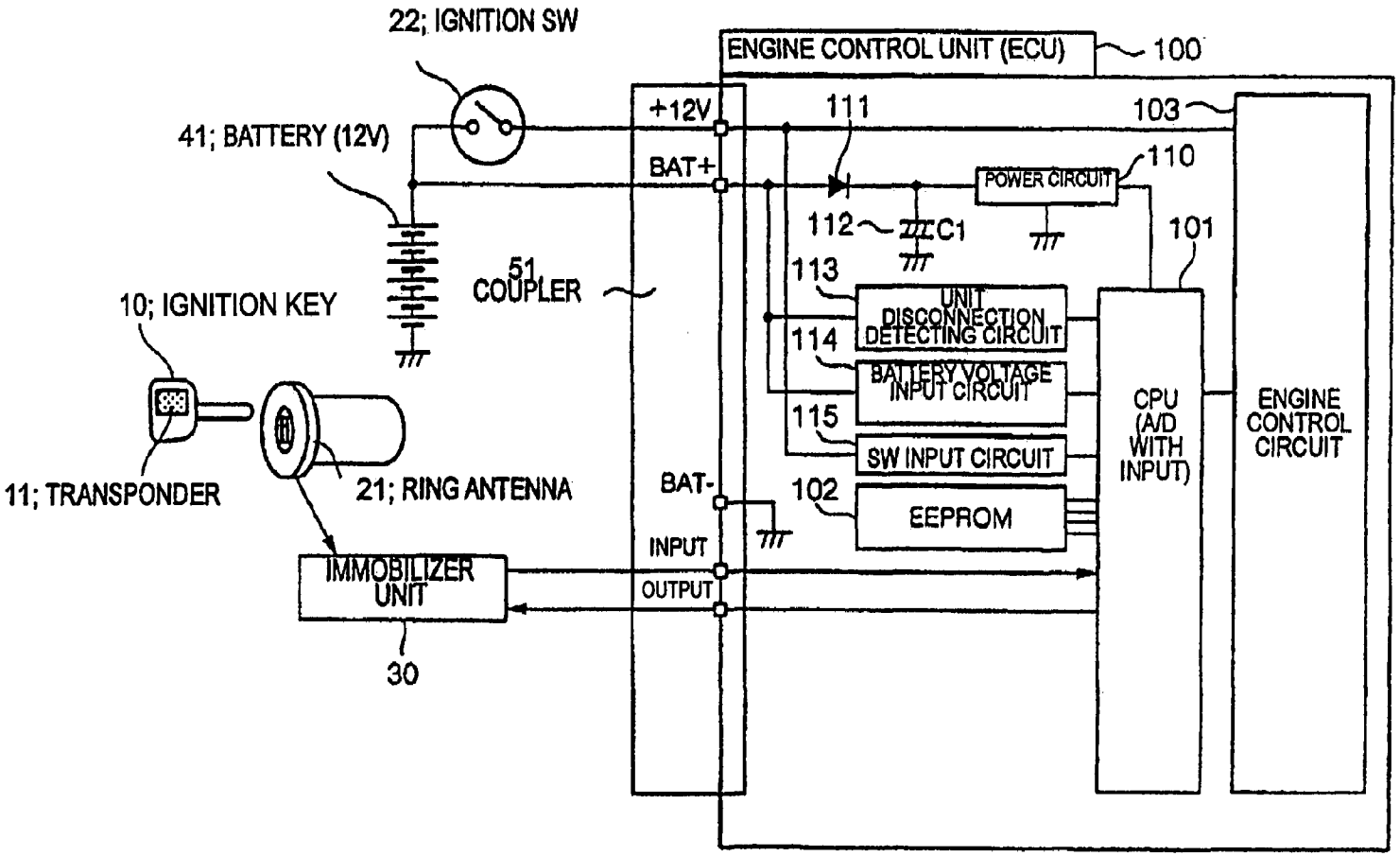
FIG. 2 is a block diagram showing an example of the structure of the engine control unit according to a first embodiment of the present invention.

FIG. 2 is a block diagram showing an example of the structure of the engine control unit according to a first embodiment of the present invention. In FIG. 2, the engine control unit 100 is connected to a coupler 51 and is connected to the external equipment of the battery. A battery 41 is a battery of 12V-system, and a power is supplied to a CPU 101 in the engine control unit 100 via a terminal BAT+ and a terminal BAT− of the coupler 51. An ignition SW22 is a switch for supplying a power to an engine control circuit 103 in the engine control unit 100. The immobilizer unit 30 is connected to the CPU 101 in the engine control unit 100 via the coupler 51, and is a unit to be used for collating IDs between the transponder 11 and the engine control unit 100.

The CPU 101 in the engine control unit 100 is a control computer for totally controlling the entire engine control unit 100, and an EEPROM (storage means) 102 is a memory in which the CPU 101 can write and read data, and programs or data (for example ID for collation) required for processing operation in the engine control unit 100 are stored. The engine control circuit 103 is a control circuit including means for controlling ignition of the engine or fuel injection.

The power circuit (power supply means) 110 is a stabilized power supply circuit (DC/DC converting circuit) for generating 5V power source required for CPU 101 from the 12V power source of the battery 41, which receives 12V voltage from a capacitor charging circuit including a diode 111 and a capacitor (C1) 112 and outputs 5V voltage. The capacitor charging circuit including the diode 111 and the capacitor (C1) 112 is a circuit for maintaining the operation of the CPU 101 for a predetermined time period even when input of a power from the battery 41 is blocked.

A unit disconnection detecting circuit (unit disconnection detecting means) 113 is a circuit for receiving the battery voltage BAT+, detecting that the engine control unit 100 is disconnected from the coupler 51 by detecting a voltage of the battery 41, and notifying it to the CPU 101. Likewise, it is also a circuit for detecting the battery voltage BAT+, detecting that the engine control unit 100 is connected to the coupler 51, and notifying it to the CPU 101.

A battery voltage input circuit 114 is a circuit for receiving the battery voltage BAT+, taking the battery voltage BAT+ into an A/D converter in the CPU 101, and detecting change of the battery voltage BAT+ with time. A SW input circuit 115 is a circuit for receiving the battery voltage +12V and detecting ON/OFF of the ignition SW 22.

Figure 3:
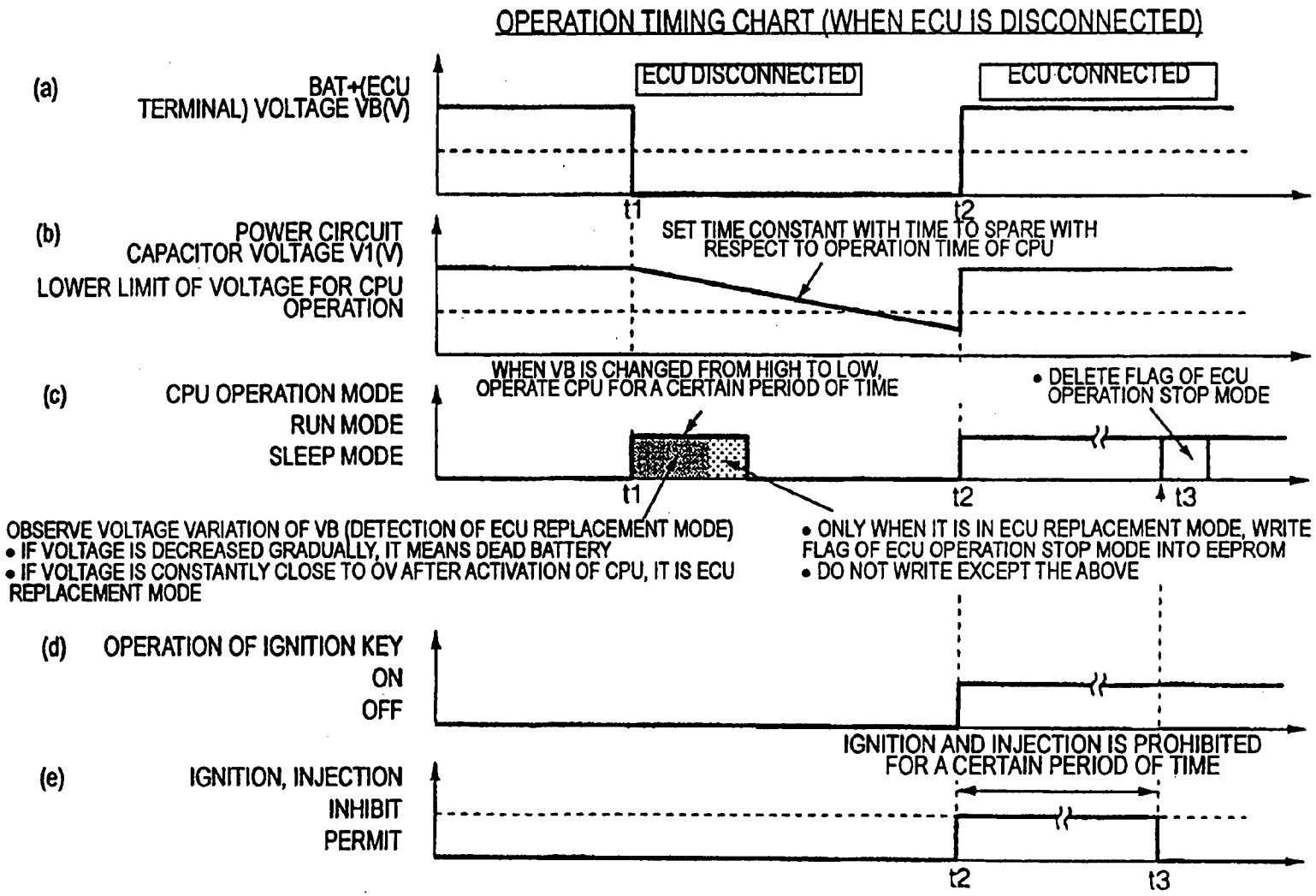
FIG. 3 is a timing chart for describing the operation in which the engine control unit is disconnected.

The engine control unit 100 shown in FIG. 2 will be described on the operation of the portion directly relating to the present invention. FIG. 3 is a timing chart for describing the operation in which the engine control unit 100 is disconnected from the coupler 51, and the operation will be described referring to FIG. 3.

In a state in which the two-wheeler 1 is in a stopped state (the ignition switch SW22 is OFF and the battery 41 is connected with the engine control unit 100), the capacitor (C1) 112 for supplying electric charge to the power circuit (power supply means) 110 of the CPU 101 is in the charged state (12V). The CPU 101 is set to a SLEEP mode (sleep mode: stop mode).

Subsequently, when the engine control unit 100 is disconnected from the coupler 51 at a timing of t1, as shown in FIG. 3(*a*), the battery voltage (ECU terminal voltage) VB is dropped immediately to 0V (zero volt). On the other hand, the capacitor (C1) 112 of the power circuit (power supply means) 110 starts discharging while supplying a power to the CPU 101 as seen in a power circuit capacitor voltage V1 in FIG. 3(*b*). The electrostatic capacity of the capacitor (C1) 112 is set to a constant for discharge at which the CPU 101 can be driven for a predetermined time period even when a power source from the battery 41 is blocked.

When the unit disconnection detecting circuit (unit disconnection detecting means) 113 detects (detection of low edge (falling edge)) that the battery voltage (ECU terminal voltage) VB is lowered, as shown in FIG. 3(*c*), the CPU 101 is interrupted at a timing of t1, and the CPU 101 transfers from the SLEEP mode (stop mode) to RUN mode for activation.

When the CPU 101 is transferred into the RUN mode, the CPU 101 takes the battery voltage (ECU terminal voltage) VB via the battery voltage input circuit 114, and determines the change in the battery voltage (ECU terminal voltage) VB with time. When the battery voltage (ECU terminal voltage) VB is suddenly lowered, or stays at a voltage level in the vicinity of 0V for a certain period of time, the CPU 101 judges that it is in "ECU unit disconnecting mode (ECU replacement mode)", and writes the "Flag of ECU operation stop mode (engine stop flag)" into the EEPROM (storage means) 102. When the voltage VB is gradually reduced, it is regarded as battery shortage, and the "Flag of ECU operation stop mode (engine stop flag)" is not written into the EEPROM (storage means) 102.

When the "Flag of ECU operation stop mode (engine stop flag)" is written in the EEPROM (storage means) 102, the CPU 101 transfers to the SLEEP mode, and stops operation.

Subsequently, when the engine control unit 100 is connected to the coupler 51 again, and the ignition SW 22 is turned ON (FIG. 3(*d*)) at a timing of t2, the unit disconnection detecting circuit (unit disconnection detecting means) 113 detects (high-edge (rising edge) detection) that the battery voltage (ECU terminal voltage) VB is restored and, as shown in FIG. 3(*c*), the CPU 101 is interrupted at a timing of t2, and the CPU 101 transfers from the SLEEP mode (sleep mode: stop mode) to the RUN mode for activation.

Then, the CPU 101 reads the "Flag of ECU operation stop mode (engine stop flag)" from the EEPROM (storage means) 102, and when the engine stop flag is stored, the engine stop signals are outputted to the engine control circuit 103 for a certain period of time (for example, about 3 to 10 minutes). Upon reception these signals, the engine control circuit 103 prohibits ignition of the engine and injection of fuel for a certain period of time (time period t2–t3 in FIG. 3(*e*)).

In the CPU 101, the "Flag of ECU operation stop mode (engine stop flag)" is deleted (at a timing of t3 in FIG. 3(*c*)).

In a series of operations described above, activation of the engine can be prohibited for a certain period of time after car wash, and current leakage from the battery 41 can be reduced by gaining time for drying the vehicle.

Figure 4:
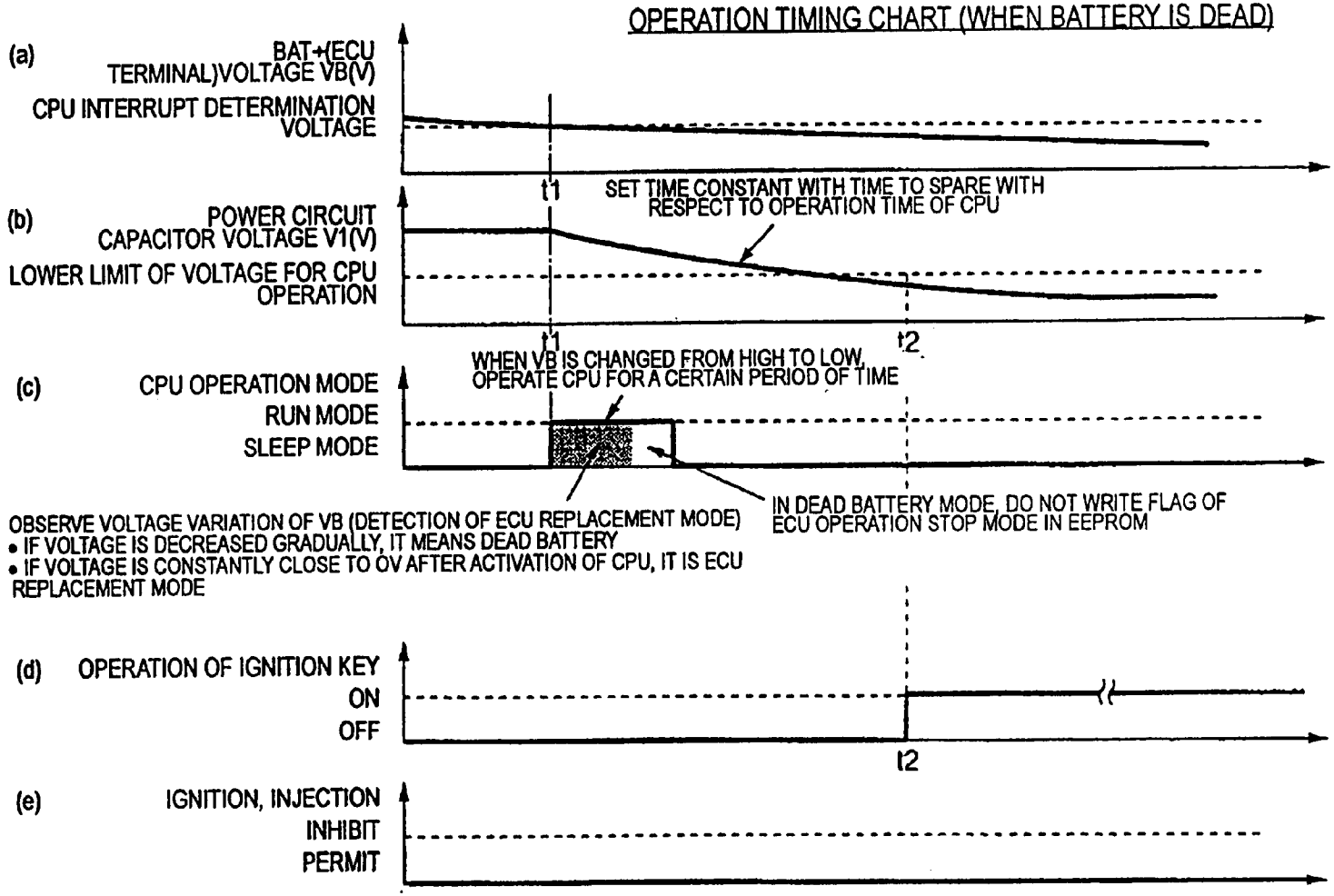
FIG. 4 is a timing chart for describing the operation in case of battery shortage.

FIG. 4 is a timing chart for describing the operation of the engine control unit in the case where the battery is lowered due to deterioration of the battery (battery shortage), and referring to FIG. 4, the operation will be described below.

In a state in which the two-wheeler 1 is stopped (the ignition SW 22 is OFF and the battery 41 is connected to the engine control unit 100), the capacitor 112 (C1) of the power circuit (power supply means) for the CPU 101 is in the charged state (FIG. 4(*b*)). The CPU 101 is set to a SLEEP mode (stop mode) for reducing the waiting current.

Subsequently, due to deterioration of the battery 41, as shown in FIG. 4(*a*), the battery voltage (ECU terminal voltage) VB is gradually lowered, and when the battery voltage input circuit 114 detects that the battery voltage is lowered to the CPU interruption determination voltage at a timing of t1, the CPU 101 activates interruption and changes into the RUN mode, as shown in FIG. 4(*c*).

When the CPU 101 is activated and changed into the RUN mode, the CPU 101 observes variations in battery voltage (ECU terminal voltage) VB shown in FIG. 4(*a*) and, when the voltage VB gradually varies, it is regarded as being in the "battery shortage mode". Since this example shows the "battery shortage mode", the "Flag of ECU operation stop mode (engine stop flag)" is not written in the EEPROM (storage means) 102. If the battery voltage (ECU terminal voltage) VB is maintained at the vicinity of 0V after the CPU 101 is activated, the "Flag of ECU operation stop mode (engine stop flag)" is written into the EEPROM (storage means) 102.

After determination of the "battery shortage mode", the CPU 101 changes again to the SLEEP mode and stops operation.

Subsequently, as shown in FIG. 4(*d*), even when the ignition SW 22 is turned ON at a timing of t2, since the battery is short, the CPU 101 cannot be activated, and thus the engine cannot be started.

Figure 5:
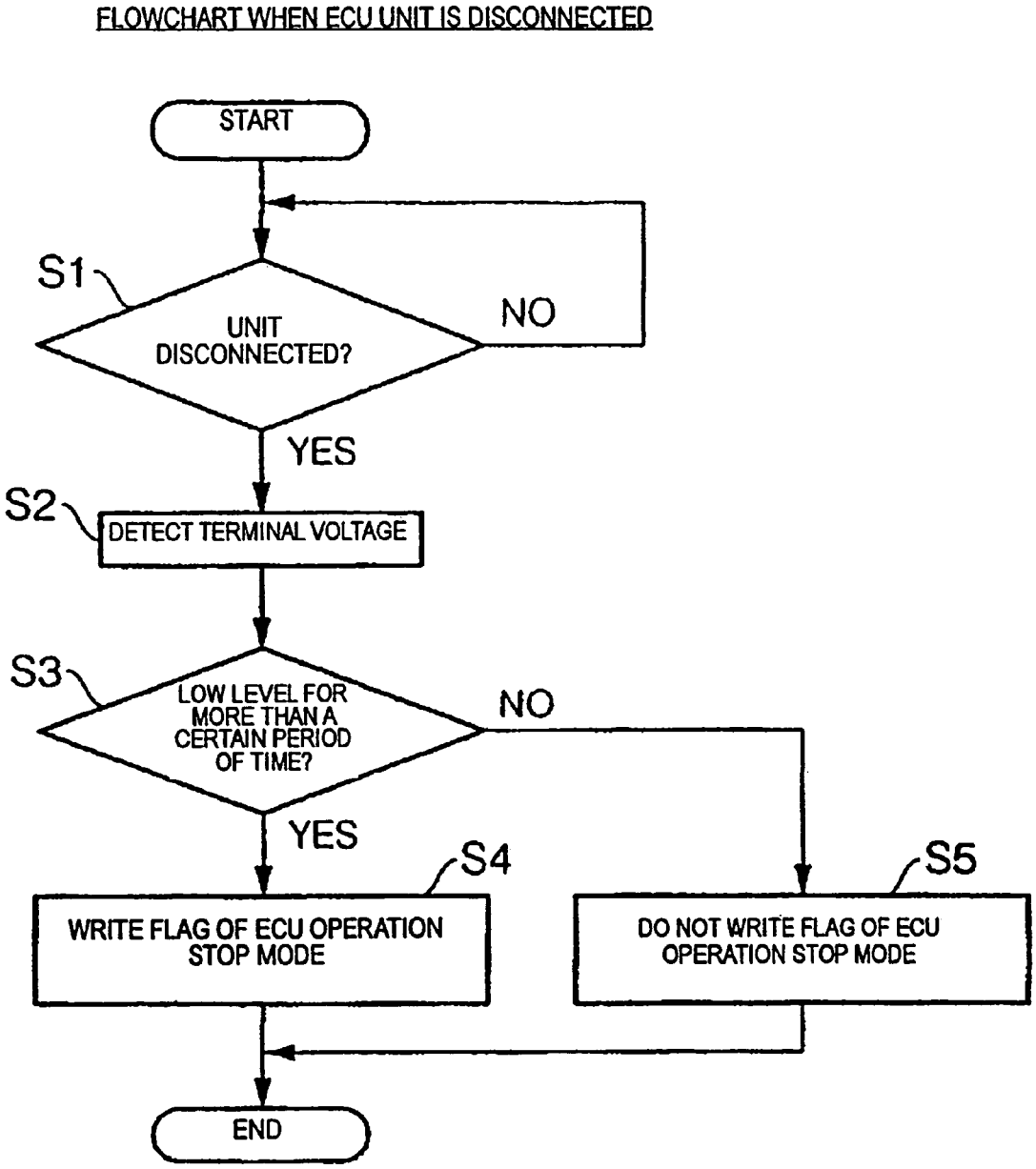
FIG. 5 is a flow chart showing a flow of the process of disconnecting the engine control unit.

FIG. 5 is a flowchart showing a flow of a process in the engine control unit 100, showing a flow of the process when the engine control unit 100 is disconnected. Referring now to a flowchart in FIG. 5, a flow of the process when the engine control unit 100 is disconnected is shown.

First, the unit disconnection detecting circuit (unit disconnection detecting means) 113 detects that the engine control unit 100 is disconnected (Step S1).

Subsequently, the battery voltage (ECU terminal voltage) VB (FIG. 3(*a*)) is detected by the battery voltage input circuit 114 and the CPU 101 (Step S2).

Then, variations of the battery voltage (ECU terminal voltage) VB with time is detected, and whether or not it is kept at a LOW level (for example, in the vicinity of 0V) for more than a certain time period (Step S3).

When it is kept at the LOW level (low level) for more than a certain period of time, the "Flag of ECU operation stop mode (engine stop flag)" is written (S4) in the EEPROM 102. When it is not kept at the LOW level for more than a predetermined time period, the "Flag of ECU operation stop mode (engine stop flag)" is not written (S5).

In this manner, when the engine control unit 100 is disconnected, the "Flag of ECU operation stop mode (engine stop flag)" is written in the EEPROM 102, and when the voltage is reduced by deterioration of the battery, the "Flag of ECU operation stop mode (engine stop flag)" is not written therein.

Figure 6:
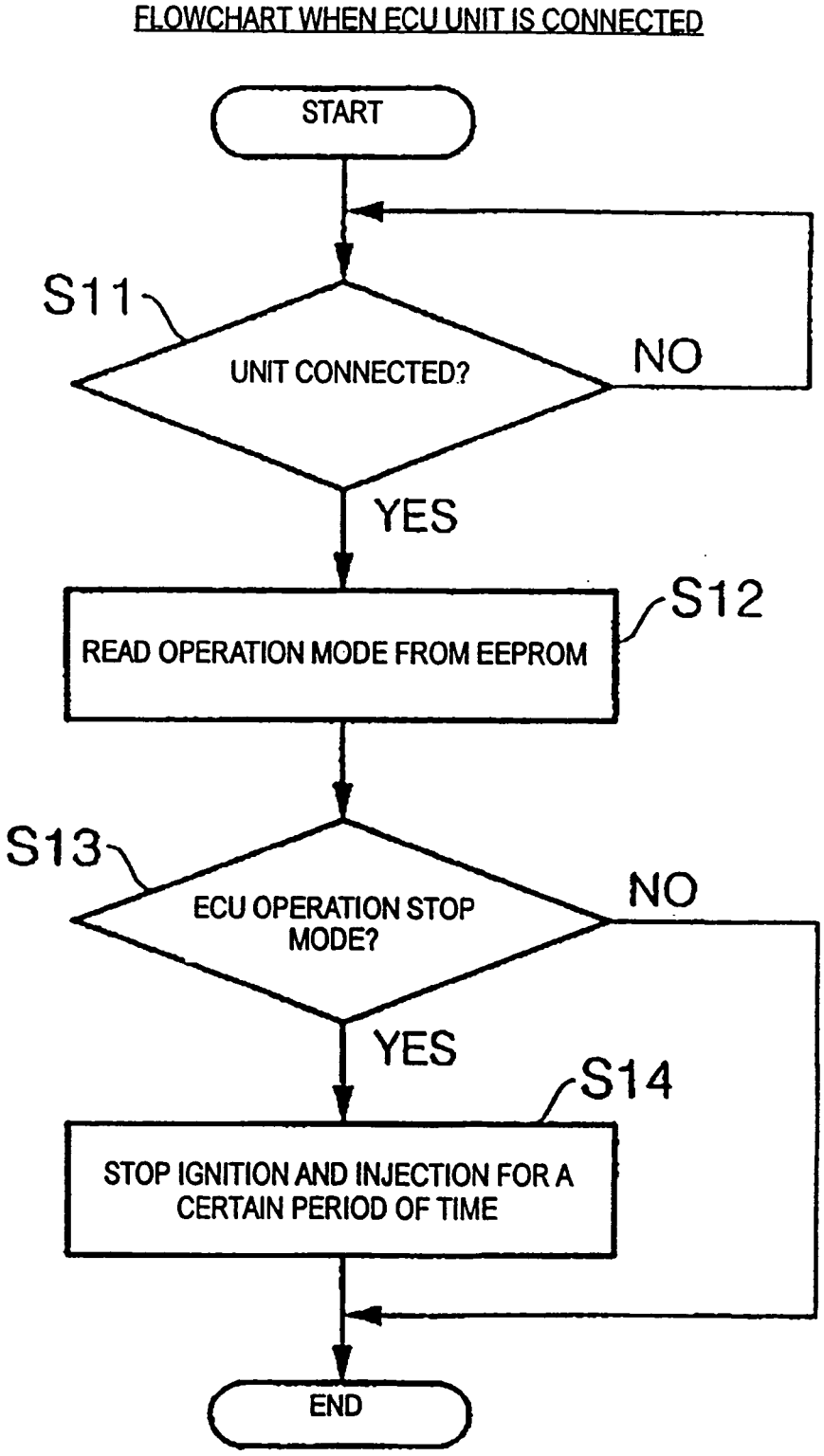
FIG. 6 is a flow chart showing a flow of the process of connecting the engine control unit according to the present invention.

FIG. 6 shows a flow of the process when connecting the engine control unit 100, and referring to the flowchart in FIG. 6, a flow of the process when connecting the engine control unit 100 will be described.

First, the unit disconnection detecting circuit 113 (or the battery voltage input circuit 114) detects the battery voltage (ECU terminal voltage) VB, and determines whether or not the engine control unit 100 is connected to the coupler 51 (Step S11).

When it is confirmed that the engine control unit 100 is connected, the CPU 101 reads the "Flag of ECU operation stop mode (engine stop flag)" from the EEPROM 102 (Step S12). Then, it determines whether or not it is in "ECU operation stop mode" (Step S13).

When in the "ECU operation stop mode", ignition of the engine or injection of fuel is stopped for a predetermined time period (for example, 3 to 10 minutes) (Step S14). When it is not in the "ECU operation stop mode", ignition of the engine and injection of fuel are not stopped.

In this manner, when the engine control unit 100 is connected, and the "Flag of ECU operation stop mode (engine stop flag)" is written in the EEPROM 102, the engine is prohibited from being started for a certain period of time so as to wait until the wiring or the like of the power supply system is dried.

Figure 7:
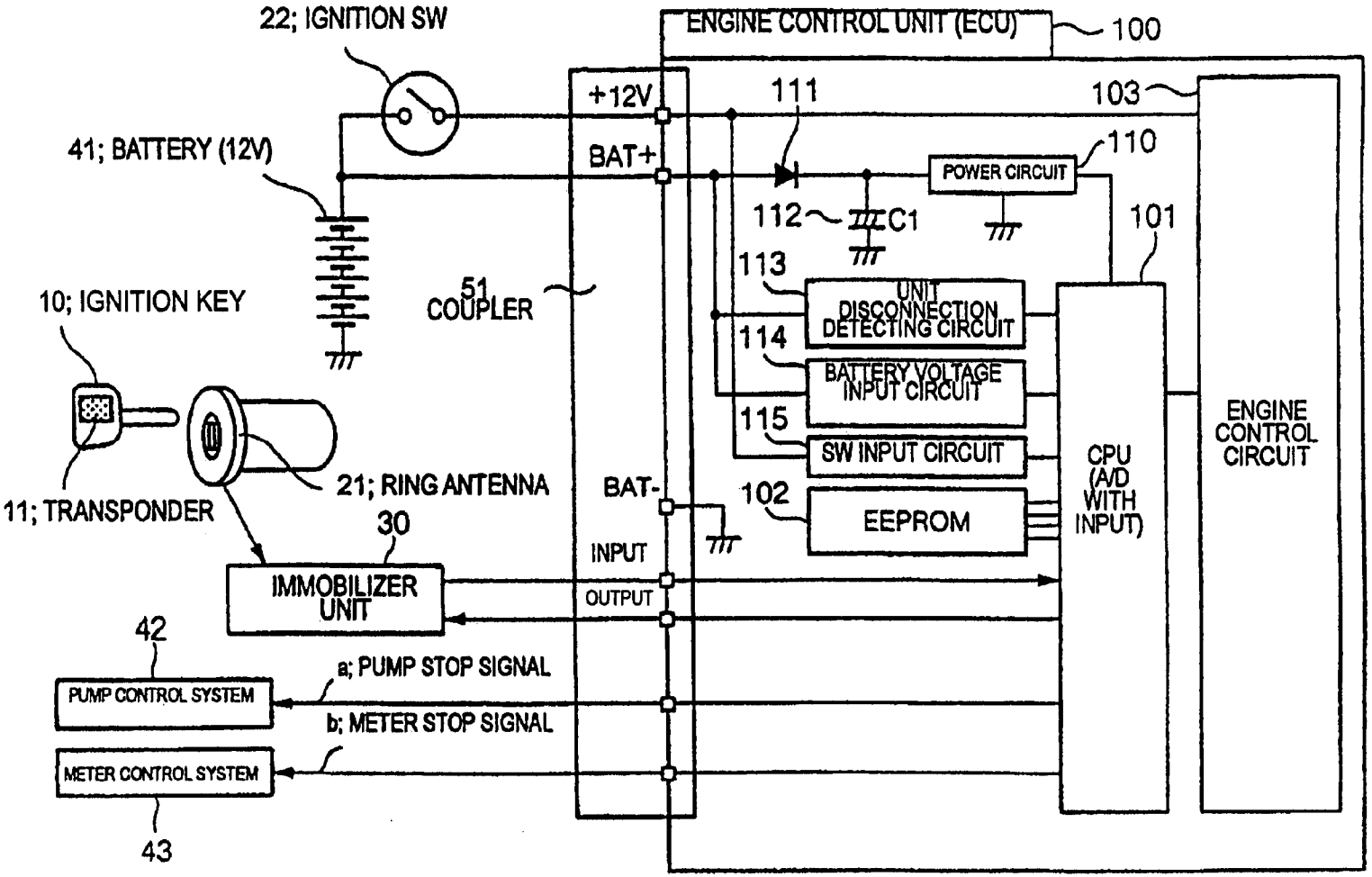
FIG. 7 is a block diagram showing a structure of the engine control unit according to a second embodiment of the present invention.

FIG. 7 is a drawing showing an example of the structure of the engine control unit according to the second embodiment. In the first embodiment shown in FIG. 2, an example in which ignition of the engine and injection of fuel are stopped for a certain period of time after the engine control unit 100 is connected is shown. However, in the second embodiment shown in FIG. 7, operation of the pump system and the meter (including indicators) system are also prohibited.

In FIG. 7, when it is determined to be the "ECU operation stop mode" when connecting the engine control unit 100, the engine is prohibited from being started for a certain period of time, and a pump stop signal (line a with an arrow) is fed from the CPU 101 to a pump control system 42, so that the pump cannot be operated for a certain period of time. A meter stop signal (line b with an arrow) is fed from the CPU 101 to a meter control system 43 so that the meter (including indicators) is not operated for a certain period of time.

In this arrangement, when the engine control unit 100 is connected to the coupler 51, when the function according to the present invention is integrated, no display of the meter (including indicators) is appeared for a certain period of time. When the function according to the present invention is not integrated, display of the meter (including indicators) appears immediately. Accordingly, whether or not the engine control unit according to the present invention is used can easily be confirmed.

In order to confirm whether or not the engine control unit 100 according to the present invention is used, for example, a LED (light emitting diode) display is provided on the engine control unit 100 for identification.

Figure 8:
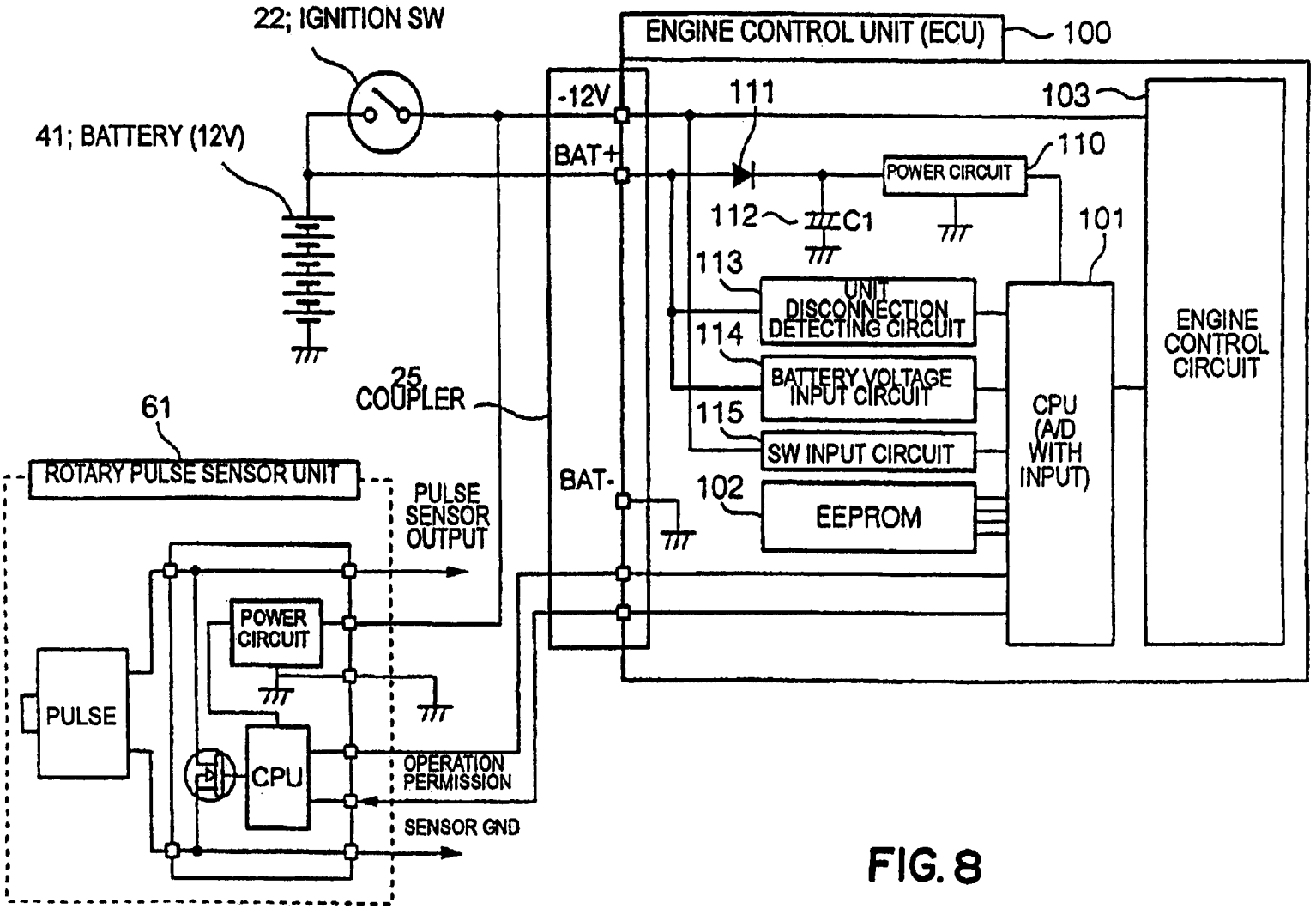
FIG. 8 is a block diagram showing a structure of the engine control unit according to a third embodiment of the present invention.

FIG. 8 is a drawing showing a third embodiment of the engine control unit of the present invention. In the examples shown in FIG. 2 and FIG. 7, a method of prohibiting ignition of the engine or fuel supply as means for prohibiting the engine from being started. In contrast, in the example shown in FIG. 8, when an operation permission signal is transmitted from the CPU 101 to a part, such as a rotary pulse sensor unit 61, for stopping the engine immediately when the function of its own is stopped, so that the rotary pulse sensor unit 61 can be operated after obtaining permission from the CPU 101.

As described above, since the engine control unit of the present invention does not permit operation of the engine for a certain period of time in the case where the engine control unit is reconnected to the external power source (battery) after the engine control unit is disconnected once, it can be adapted in such a manner that after the vehicle is washed, operation of the engine is permitted only after water drops or the like are dried accordingly, and thus the effect of leakage at the ignition system or the like due to water drops may be reduced.

In the engine control unit according to the present invention, since the engine control unit permits operation of the engine according to the result of collation between the ID code received from the outside and the ID code which is registered in advance, when a predetermined time period is elapsed after the engine control unit is connected to the external power source (battery), the normal process routine of an immobilizer is restored, and thus it is not necessary to modify the conventional process routine significantly, which realizes reduction of cost in design accordingly.

In the engine control unit of the present invention, the engine control unit is adapted to stop operation of other control systems which are not used for controlling the engine for a predetermined time period when the engine control unit is connected and the power is supplied again, whether or not it is an engine control unit according to the present invention can be identified simply by checking the displayed state of the meter and the like, accordingly.

In the engine control unit of the present invention, since the unit disconnection detecting means is adapted to observe an input voltage based on variations in the input voltage at the power supply means and, when the voltage has not reached a predetermined value for more than a certain period of time, determines that the engine control unit is disconnected, disconnection of the engine control unit and battery shortage can be identified for controlling, accordingly.

Although the embodiments of the present invention has been described thus far, the engine control unit of the present invention is not limited to the example in the drawings described above, various modification may be made without departing the scope of the present invention, as a matter of course.

I claim:

1. An engine control unit for controlling operation of a vehicle engine provided with power supply means for receiving a power from an external power source and supplying a power required for the engine control unit, the engine control unit comprising:

unit disconnection detecting means for detecting that the engine control unit is disconnected from the external power source and that the engine control unit is connected to the external power source, means for determining change in voltage from the external power source where the change in voltage is a sudden decrease in voltage or is a voltage in the vicinity of 0V for a period of time, and storage means for staring predetermined information, wherein the engine control unit stores an engine stop flag in the storage means when disconnection of the engine control unit is detected by the unit disconnection detecting means or when there is a sudden decrease in voltage or when there is a voltage in the vicinity of 0V for a period of time detected by the change in voltage determining means, said engine control unit permitting operation of the engine for a predetermined time period in the case where the engine stop flag is stored in the storage means.

2. An engine control unit according to claim 1 wherein the engine control unit permits operation of the engine according to the result of collation between an ID code received from the outside and the ID code which is registered in advance.

3. An engine control unit according to claim 1 wherein the engine control unit also stops operation of control systems which are not used for controlling the engine for a predetermined time period in the case where the engine stop flag is stored in the storage means when a power is supplied from the external power source.

4. An engine control unit according to claim 1 wherein the unit disconnection detecting means observes an input voltage based on variations in the input voltage at the power supply means and, when the voltage has not reached a predetermined value for more than a certain period of time, determines that the engine control unit is disconnected.

5. An engine control unit according to claim 3 wherein the control systems comprises a pump control system or a meter control system.

* * * * *